US005441402A

United States Patent [19]

Reuther et al.

[11] Patent Number: 5,441,402

[45] Date of Patent: Aug. 15, 1995

[54] EMISSION REDUCTION

[75] Inventors: James J. Reuther, Worthington, Ohio; Irwin H. Billick, Prospect Heights, Ill.

[73] Assignee: Gas Research Institute, Chicago, Ill.

[21] Appl. No.: 144,680

[22] Filed: Oct. 28, 1993

[51] Int. Cl.[6] ..... F23D 3/40

[52] U.S. Cl. ..... 431/7; 431/328

[58] Field of Search ..... 431/328, 329, 7

[56] References Cited

U.S. PATENT DOCUMENTS

| | | | |
|---|---|---|---|
| 3,847,534 | 11/1974 | Nomaguchi et al. | 431/329 |
| 4,480,988 | 11/1984 | Okabayashi et al. | 431/329 |
| 4,525,141 | 6/1985 | DeWerth et al. | 431/347 |
| 4,629,415 | 12/1986 | DeWerth et al. | 431/347 |
| 4,652,236 | 5/1987 | Viessmann | 431/350 |
| 4,721,456 | 1/1988 | Granberg et al. | 431/328 |
| 4,746,287 | 5/1988 | Lannutti | 431/328 |
| 4,776,320 | 10/1988 | Ripka et al. | 126/99 |
| 4,790,744 | 12/1988 | Bellet et al. | 431/75 |
| 4,919,609 | 4/1990 | Sarkisian et al. | 431/7 |
| 5,073,106 | 12/1991 | Toyonaga et al. | 431/285 |
| 5,137,583 | 8/1992 | Parent et al. | 431/328 |
| 5,205,731 | 4/1993 | Reuther et al. | 431/328 |

FOREIGN PATENT DOCUMENTS

| | | | |
|---|---|---|---|
| 334736 | 9/1989 | European Pat. Off. | 431/329 |
| 56514 | 5/1981 | Japan | 431/328 |
| 108914 | 5/1987 | Japan | 431/329 |

*Primary Examiner*—Carroll B. Dority

*Attorney, Agent, or Firm*—Philip M. Dunson; Philip J. Pollick

[57] ABSTRACT

Methods and apparatus for burning a mixture of natural gas and air in a ratio that is slightly fuel rich to slightly fuel lean with substantially minimal emission of gaseous pollutants containing nitrogen, hydrogen, or carbon. The mixture is provided along a predetermined path in a non-radiant burner and is ignited to provide a blue flame in a predetermined burning region. A refractory porous member located in the cool region adjacent to the upstream end of the burning region reduces the temperature of combustion slightly by scavenging a substantial fraction of the excess free radicals that are critical to the formation of nascent NO and its conversion to $NO_2$ and the nitrogen acids. Typically the porosity in the porous member is about 92 to 97 percent and its thickness is such that it extends into the flame to a level at about 25 to 50 percent of the height of the flame. The mixture typically comprises about 80 to 120 percent theoretical air.

11 Claims, 2 Drawing Sheets

EMISSION REDUCTION

FIELD

This invention relates to reducing undesirable emissions from gas burning apparatus. It has to do more particularly with apparatus and methods in which gas-appliance burners include, or are retrofit with, a porous member that reduces the emission of various products of combustion. An important feature of the invention is the positioning of such a member, with specified porosity and thickness, upstream of blue flames burning within a preferred range of fuel to air ratios.

BACKGROUND

Because of evolving environmental regulations, notably Titles I and III of the 1990 Clean Air Act, the management of chemical emissions from practical natural gas flames may be required. Chemical emissions of concern include carbon monoxide CO; oxides of nitrogen, $NO_x$, where x=1 or 2; acids of nitrogen $HNO_y$, where y=2 or 3; formaldehyde, $CH_2O$; and air toxins, $C_mH_nO_z$, where m=1–70, n=1–32, and z=0–12. The goal is to control these emissions simultaneously.

The present invention, on an unvented or vented gas-appliance burner, is intended to allow a variety of contemporary and future gas appliances to be operated with significantly reduced emissions to the indoor and outdoor atmosphere. By significantly reduced is meant that the concentrations of the designated pollutants are lowered to less than 10 parts per million (ppm).

Past attempts to accomplish the goal of simultaneous emissions control have not been successful. Continued lack of success may endanger the continued use of gas appliances for cooking, space heating, water heating, and other domestic, commercial, or industrial uses, as the increased use of electric appliances, which do not have the same heating element emissions problem, may be encouraged.

Some emissions are products of complete combustion, while others are products of incomplete combustion, or of other chemical reactions that take place in or near the flame, which poses a dilemma. Strategies for the control of one trace emission may be incompatible with strategies for the control of another. Often the concentration of one pollutant may be reduced significantly while that for another remains unchanged or even increases. Strategies for the control of single pollutants are somewhat understood and workable, but a basis for the simultaneous control of all unwanted combustion related emissions, particularly those identified here, has heretofore remained unclear [1-45].

Two general approaches are known for reducing emissions from gas-appliance burners [38]. One involves adding an object to an appliance burner, usually without an accompanying change in operating conditions. The object, which glows red hot in the flame, is called a "radiant insert" and is either solid (flame gases flow around) [24] or porous (flames gases flow through) [26]. In tests on gas appliances, both types of inserts have typically reduced NO by about 50%, $NO_2$ by about 25%, and have caused either no change or an increase in CO. Emissions remained at double-digit ppm levels. The effects on the other pollutants of interest are not known. Hence, the ultimate objective of total emissions control has not been achieved by the use of radiant inserts.

The other approach involves replacing a conventional appliance burner with a new one, called a "radiant" burner. Instead of blue flames appearing at the ports of a relatively "cool" burner, no flames are apparent, and the burner glows red hot at about 1000° C. In tests with radiant burners, NO emissions were reduced by as much as about 90%, to near single-digit ppm levels, but with increases, to double-digit levels, in $NO_2$, $CH_2O$ and $HNO_y$ (32,40,42,44,45).

Efforts were undertaken to confirm these findings [31,40]. Confirmation of baseline emissions data, and their alteration upon the use of radiant inserts or burners, was necessary because of doubts about their accuracy. Emissions data are sometimes inadvertently biased or distorted by the methods by which they are determined [31]. The results just reviewed were found to be correct; that is, they were not measurement-protocol specific. So they could be reliably used as baseline data.

A comprehensive review of the combustion literature indicated that although data about the ability of radiant inserts or burners to reduce emissions were valid, the rationales presented to explain their action were suspect. Ambiguities were found that led to the present invention. An analysis of fundamental combustion mechanisms also revealed a plausible and defensible explanation of why radiant inserts and burners might be effective at NO reduction, but little else. Moreover, this analysis also revealed how an innovative approach, counter to that taught by the prior art, might achieve the objective of total emissions control.

Flames are either of the diffusion or premixed type, depending on whether none, some, all, or more of the air required for complete combustion is mixed with the fuel before it reaches the burner outlet. This mixing is called primary aeration. If primary aeration is zero, a diffusion flame exits, burning where 100% of the air required for complete combustion becomes available. If the primary aeration is between 60 and 200%, the flammability limits for premixed natural gas, flames exist. When the primary aeration is about 60 to not quite 100%, premixed flames are called "partially premixed" or "fuel rich"; when 100%, they are called "stoichiometric" or "fully premixed"; and when greater than 100%, they are called "fuel lean" or "having excess air". Most gas-appliance burners operate with partially premixed flames [1,22,31,38].

Two distinctions are often overlooked regarding a partially premixed flame. First, it consists not of one flame, but two flames in series: an inner fuel-rich premixed flame, followed by an outer, stoichiometric diffusion flame. Second, allowable primary aeration can be less than 60%, because the downstream diffusion flame acts as a pilot. Most combustion research is conducted on single flames, even if partially premixed [1-12,14-21].The downstream diffusion flame is eliminated by burning the premixed flame in an inert atmosphere, usually nitrogen ($N_2$).

These definitions and distinctions were critical to the conception of this invention, because their effect on strategies for emissions reduction appears not to have been properly taken into account, as will be explained after critical definitions and distinctions are made regarding emissions formation.

Flames are capable of oxidizing not only the natural-gas fuel to $CO_x$, but also the $N_2$, which constitutes about 79% of air, to NO. The NO formation mechanism has been the subject of considerable analysis [17]. Research indicates that there are probably two mechanisms by which $N_2$ is oxidized to NO in flames. Named for their discoverers, they are "Fenimore-NO" (F-NO) and "Zeldovich-NO" (Z-NO) [4,17]. Several features of these mechanisms have been widely discussed and applied in simplified form without question or qualification. Noticing this lack of rigor, detail, and regard for proper application led us to the present invention and our understanding of its probable mechanism.

For example, it is widely accepted that Z-NO forms primarily downstream of the flame ("late"), has a positive temperature dependence (the hotter the flame, the more Z-NO), dominates at primary aeration at levels greater than 100%, and has the following chemistry [4,17,45]:

$$N_2+O=NO+N \quad (1)$$

$$N+OH=NO+H \quad (2)$$

$$O_2+N=NO+O \quad (3)$$

It is also widely accepted that F-NO forms "promptly" in the flame, is independent of temperature, dominates at primary aeration levels less than 100% and has this chemistry (x=1–3): (17,23)

$$N_2+CH_x=HCN+N \quad (4)$$

followed by the oxidation of hydrogen cyanide (HCN) and Reaction (3) to convert the atomic nitrogen (N) to NO. Awareness of linkage between the formation chemistries of Z-NO and F-NO via the mutual N-radical also helped in the conception of the present invention.

This background information suggests a strategy for Z-NO, but not F-NO, control. That is, burn at a high level of primary aeration in a flame that is highly cooled. If the state of the art is assumed to be information presented at the 1992 International Gas Research Conference, this strategy has promise, as papers teach that near single-digit ppm NO levels are achieved by premixed radiant burners, operating at 130% primary air and burner surface temperatures of about 1000° C.[41,45].

While a strategy for just the Z-NO component of the total emissions-control problem might seem fairly straightforward, strategies for the others are not. The effect of Z-NO control on F-NO, $NO_2$, $HNO_2$, $HNO_3$, CO, and $CH_2O$ is somewhat known, and appears to be adverse. Data indicate that most, if not all, remaining NO may appear as $NO_2$, and that $HNO_2$ and $CH_2O$ may become new emissions problems [40]. The literature acknowledges that practicable strategies for F-NO control are not known [17,42,43,45].

An analysis was conducted to understand why $NO_2$, $HNO_2$, and $HNO_3$ were traded for NO in the best available control strategy, radiant burning [45], and why radiant burner inserts could effect, at best, only a 50% reduction in NO and a 25% reduction in $NO_2$[24,26].

Whereas NO is formed early in a flame, via the oxidation of $N_2$ in combustion air, $NO_2$ is probably produced after the flame, via the oxidation of NO [13,19,21]. Conversion of NO to $NO_2$ is promoted by trace hydrocarbons (HCs), and by thermal quenching [21,25,27,29]. The latter translates to lowered temperatures favoring $NO_2$ formation, which supports the comment that while a strategy may reduce one pollutant, it may increase another: e.g., lowered temperatures reduce NO, but increase $NO_2$.

One or the other of these $NO_2$-promoting conditions is inherent in conventional partially-premixed "high-NO" flames (FNO +Z-NO), and state-of-the-art fuel-lean "low-NO" (F-NO) ones. Any NO generated in the inner fuel-rich flame is exposed to HCs as it is transported into the outer diffusion flame. NO generated by an outer or single flame is subject to quenching via contact with secondary air. The result of these effects is to favor conversion of NO to $NO_2$, which is the precursor to the N-acids, $HNO_2$ and $HNO_3$, and to maintain high in-flame concentrations of CO [26].

Initial research on the mechanisms for $HNO_2$ and $HNO_3$formation suggests that these species are probably affected in the same manner as $NO_2$. Lower, or lowered, temperatures favor their formation [16], implying that they are probably formed indirectly, via oxidization of F-NO derived $NO_2$.

With this understanding in mind, it became apparent why the use of a radiant insert or burner would not be expected to cause a simultaneous reduction in NO, $NO_2$, and N-acids. Any, if not most, of the NO not prevented from forming, would be readily converted to $NO_2$ and the N-acids by the procedures used to suppress Z-NO formation. Hence, these species probably could only be reduced to ultra-low levels by eliminating nascent NO, or the F-NO.

The preceding analysis revealed a new strategy for total emissions control. An insert might be more effective if it is non-radiant, is inserted at an upstream flame position that is cool, and minimizes contact of NO and trace hydrocarbons with cool secondary air. This strategy suggested a highly porous member be positioned at the base, or cooler, region of a stoichiometric premixed flame. These conditions seem never to have been tested, as we could find no data for inserts in flames with primary aeration greater than 60%, or at positions early in any flame. However, speculation in one patent on a radiant solid insert states that if its position were in the near-flame zone, NO and CO emissions might increase, rather than decrease [24]. The effect of inserting a porous structure into this near-flame zone was not known, but it seemed to us to be worth testing.

Experiments were conducted using an apparatus called a Uniburner, a device that allows the effects of burner design and operation on emissions to be reliably evaluated under welldefined and controlled and realistic conditions [31]. Emissions were sampled using two different complementary techniques. A direct technique employed a sampling probe, and was conducted using a protocol the reliability of which had been validated via international interlaboratory testing [31]. An indirect technique employed a chamber method, the results of which have also been validated [40]. Data acquired using both methodologies, executed by independent researchers, were in agreement.

Baseline emissions were measured for a generic rangetop burner cap [31]. The operating conditions under which this burner generated the highest concentration of total emissions was a firing rate of 9.4 KBtu/hour, which fixed its port loading at 36.2 KBtu/hour-inch$^2$ and a primary aeration of 60% Under these baseline conditions, the partially premixed dual-blue flame emitted 70 ppm NO, 30 ppm $NO_2$, and 100 ppm CO. Emissions for $HNO_2$, $HNO_3$ and $CH_2O$ were already at single-digit ppm levels, 3, 1, and 0.5 ppm, respectively [40].

Within experimental uncertainty, as primary aeration was increased from 60% to 100%, with no change in firing rate or port loading, baseline emissions remain unchanged. Results elsewhere confirmed the same trend for NO and $NO_2$ emissions from different rangetop burners, indicating that the baseline data obtained here were typical, and not rangetop burner-cap specific [38].

Different porous inserts were tested. Variables included thickness, with respect to flame height, and porosity, with respect to pressure drop. Favorable results were obtained using a porous member 0.25 inch thick with 94% porosity. Unfavorable results, that is, increases in emissions, especially CO, were obtained when porous inserts were made with lower porosity (81, 87, and 90%) or thickness (0.125) inch.[46]

Emission tests produced encouraging and surprising results. At 100% primary aeration, where the non-radiant porous insert was expected to be effective, baseline emissions were reduced by 86% for NO, 89% for $NO_2$, 81% for $HNO_2$, 70% for $CH_2O$, and 74% for CO. These dramatic reductions, averaging about 80%, resulted in single-digit ppm emissions for all species except CO, or near-total emissions control.

A surprising result occurred at 85% primary air, the only intermediate level tested. At 85% primary aeration, at which porous inserts had not been expected to have any special effect, a composite reduction of about 50% was observed in NO, $NO_2$, and CO emissions.

This last unexpected result implied that non-radiant porous inserts may have promise in appliances with "atmospheric" burners, whose venturis can achieve primary aeration as high as 85% [38]. Although not total emissions control, as defined here, the partial overall reduction that can be achieved may extend the allowed lifetime of current gas appliances, if and when regulations requiring emissions control are enacted. Many current gas appliances do not require a fan to achieve their operating level of primary aeration. Effective emissions control for them could consist of the mere retrofitting of the gas appliance burner with a porous insert.

If the porous insert had effectively controlled emissions only at primary aeration of at least 100%, gas appliances would need both a porous insert and a fan, which would not be as technically straightforward or economically favorable. Because fans are being integrated more frequently into the designs of next-generation gas appliances, the use of the new porous-insert technology may remain a simple retrofit process in the future.

To summarize, the technical literature appears to contain no information on the concept of a non-radiant porous insert as an emissions control technology for blue flames on gas appliances.

DISCLOSURE

The present invention offers a technology by which to simultaneously and significantly reduce the emission of NO, $NO_2$, $HNO_2$, $HNO_3$, CO, and $CH_2O$ from current and future gas appliances. The control of such emissions may become the subject of government regulations on indoor and outdoor air quality.

The invention can assist in complying with such regulations.

The invention controls emissions from highly to fully premixed flames generated by gas-appliance burners, called atmospheric or fan-assisted, respectively. In fully premixed flames (at least 100% primary aeration), the overall reduction in emissions typically is about 80%, which results in single-digit parts-per-million levels, the lowest ever achieved. In partially premixed flames (at least about 85% primary aeration), the overall reduction in emissions typically is at least 50%.

The invention typically comprises a porous member, positioned within the leading surfaces of blue flames generated by gas-appliance burners, where the temperature is low enough (less than about 700° C.) that the porous member does not heat enough to radiate. Remaining non-radiant is important to emissions-control effectiveness.

The porous member may be constructed of metal, ceramic, or other refractory temperature stable materials, provided they can be fabricated into various shapes having a porosity of about 92 to 97 percent, and can withstand temperatures of at least about 1000° C. The geometry and dimensions of the porous member are specific to the gas-appliance burner onto which it is adapted, and the flames it generates. The thickness of the porous member must be a fraction, typically about 25 to 50 percent, of the height of the blue flames into which it is positioned.

U.S. Pat, No. 5,205,731 recently issued for a new porous gas burner on the basis that it operated in the nonradiant flame mode, thereby making it different from previous porous gas burners [49]. The porous member invention disclosed herein and this newly patented porous burner differ in intent, design, construction, and performance. The only commonality shared is that they both operate in the blue-flame mode and both reduce NO emissions.

With regard to intent, the patented porous burner (shown in FIG. 2A herein) acts as a burner, that is, a stand-alone device capable of achieving flame stability and turndown[49]. The porous member 20 of FIGS. 3–5 herein was intended to be retrofit (inserted) onto a gas burner 10 (as in FIG. 1 or FIG. 6 herein) that inherently provided flame stability. The porous insert is not intended to act as a stand-alone gas burner by virtue of its design, namely, its porosity. Whereas the optimum porosity for the porous insert is 94%, that for the nested-fiber gas burner is 85%. This difference accounts for the ability or inability of either device to stabilize a natural-gas flame. Moreover with regard to design, the patented porous burner can be constructed only of sintered "nests" of fibers, whereas the present porous member can be constructed of any refractory material that can be produced with a porosity in the mid-90% range.

Finally, with regard to performance, the new patented burner reduces NO and CO to double-digit ppm levels, whereas the present porous insert 20 simultaneously reduces $NO_x$ (NO and $NO_2$) CO, $HNO_3$, and air toxics emissions to single-digit levels.

In summary, the technologies appear to represent two different, mutually exclusive, inventions.

DRAWINGS

FIG. 1 is a schematic and partly sectional perspective view of a typical ported blue-flame gas burner in the prior art. Part A includes a conventional burner cap; part B is an enlarged view of the portion of the burner encircled in part A; and part C is an enlarged sectional view of the portion encircled in part B. In its conventional operating mode, the burner remains cool (less than about 700° C.) as blue, cone-shaped flames stabilize above each port [47]. The shapes of typical blue flames are indicated schematically in part C.

FIG. 2 is a perspective view of a typical porous radiant gas burner in the prior art. Part A includes a conventional burner cap; part B is an enlarged view of the portion of the burner encircled in part A; and part C is an enlarged sectional view of the portion encircled in part B. In its conventional operating mode, the burner glows red hot (about 1000° C.), and no blue flame appears downstream of the outlet [42].

FIG. 3 is a schematic and partly sectional perspective view of a typical gas burner according to the present invention wherein a porous member as in FIG. 2 is located adjacent to a ported blue-flame gas burner as in FIG. 1. Part A includes a conventional burner cap fitted with a porous member; part B is an enlarged view of the portion of the burner encircled in part A; and part C is an enlarged sectional view of the portion encircled in part B. In its preferred operating mode, the porous member remains cool (less than about 700° C.) as blue flame emerges from within and covers the porous medium. The shapes of typical blue flames are indicated schematically in part C.

CARRYING OUT THE INVENTION

Figure 1:
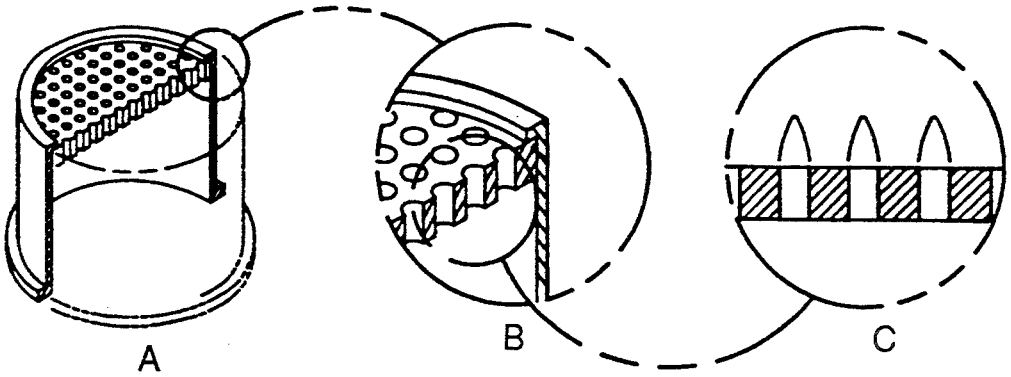
PRIOR ART FIG. 1
Figure 2:
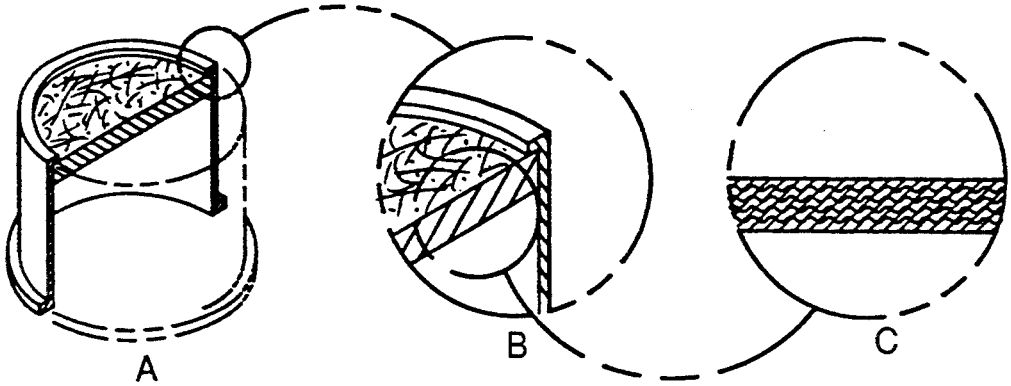
PRIOR ART FIG.2

It is widely believed that effective control of Z-NO emissions from natural-gas combustion can be achieved only if visible blue flames are avoided, radiant burner-/insert-surface temperatures are high (e.g. about 1000° C.), and primary aeration is high (e.g. about 130%) [39-45]. This conventional wisdom has dominated efforts to develop new natural-gas burners with ultra-low NO emissions.

The present invention is based on a departure from this thinking. As we experimentally observed, better NO control can be achieved if a non-radiant porous member is positioned early in blue flames and remains cool (well less than 1000° C.), flame temperatures remain very high (about 1600° C.), and the primary aeration is considerably below 130%. In addition to reducing Z-NO, effective control, previously not thought possible, can be achieved over F-NO. Moreover, by making these radical departures from convention, effective control can, for the first time, be achieved over secondary emissions that derive from NO, such as $NO_2$, $HNO_2$, and $HNO_3$, with no increase in the emission of products of incomplete combustion, CO and $CH_2O$.

The heart of the present invention, a non-radiant porous insert for blue flames, is a free-radical "filter" or "scavenger". The effect of the invention on combustion (free-radical) chemistry is thought to be more important than its effect on combustion physics (temperature), which is a reversal from how radiant inserts and burners usually are believed to achieve their emissions reduction.

Consider the influence of temperature on Z-NO. Radiant solid inserts reportedly reduce NO emissions by 50% when they cause a 250° C. reduction in temperature [24]. According to validated data on the positive temperature dependence for Z-NO formation, which indicates a 50% decrease for every 40° C. reduction in temperature, these radiant inserts should be more effective [17]. The same argument can be made for radiant burners, which have peak temperatures of about 1000° C., compared to the approximately 2000° C. temperatures for blue flames. In summary, temperature changes alone do not explain observed reductions in Z-NO emissions. Some other process appears to be in competition, causing the failure of the full effect of temperature reduction on Z-NO formation to be realized.

After a review of the combustion literature, we discovered a plausible competing process, which involves free-radical combustion chemistry. First, some background information is necessary.

It has been known for about 40 years that free radicals occur in flames at concentrations well in excess of those predicted by thermal equilibrium [3,4,9,12,17,35]. Primary free radicals are such species as hydroxyl (OH), oxygen (0), hydrogen (H), and hydroperoxyl ($HO_2$). These particular free radicals behave as a "pool" in hydrocarbon flames, meaning that the concentration profile of one generally follows those of the others [9,12]. Hence, any one of them can be used to track the overall free-radical surplus.

Free radicals are the reactants that convert natural gas, consisting mostly of methane ($CH_4$), with some ethane ($C_2H_6$), to the products of complete combustion, carbon dioxide ($CO_2$) and water ($H_2O$). This conversion is known to occur via the following sequential process [5,10,15]:

$$C_xH_y \rightarrow CH_3 \rightarrow CH_2 \rightarrow CH \rightarrow HCO \rightarrow CH_2O \rightarrow CO \rightarrow CO_2 \quad (5)$$

The conversion of atmospheric $N_2$ to nitrogen oxides and acids follows the following steps [16]:

$$N_2 \rightarrow NO \rightarrow NO_2 \rightarrow HNO_2 HNO_3 \quad (6)$$

An important part of this invention is that OH is a key reactant in each step of Mechanisms (5) and (6) [15,16]. Hence, OH is a common denominator in the mechanism for total emissions control.

That free radicals, such as OH, populate flames at "superequilibrium" concentrations is widely known to the academic community, but not to the applied-research community, whose task it is to develop low-emissions burners. A recent paper attempts to correct this situation [33]. Moreover, although this radical surplus, or "overshoot" has been definitively proven to occur, not widely appreciated is where and to what extent it occurs within flames.

To understand this invention, one should recognize that radical overshoots are not uniform throughout a flame, either in premixed ones [9,20,30,34], or in partially premixed ones [3,19,36,43]. In premixed flames, OH-radical overshoots are large early in the flame, and approach equilibrium only very late in the flame. In partially premixed flames, OH-radical overshoots are larger at the base of the dual-flame cone structure than at the tip. This spatial specificity of overshoot, which exists throughout the flame regardless of primary aeration, was a fact vital to rationalizing a mechanism for the present invention.

Returning to temperature and its role in emissions control, not intuitive or widely known, but validated experimentally and theoretically, is that as flame temperatures decrease, freeradical overshoots increase [4,9,11,20,28]. This chemical fact can be used to explain why cooling flames via radiant inserts or burners does not result in as much reduction in NO as would be expected solely on a temperature basis. While lowered temperatures slow rates of reaction, which reduces NO formation, they also increase free-radical surpluses, which increases NO formation. The increase in chemical species partially nullifies the influence on emissions production of reduced temperature.

These offsetting effects have not heretofore been identified or used in emissions control. Others apparently have not recognized that for effective total emissions control both temperature and free-radical overshoots must be reduced simultaneously. Excess free radicals typically are in the range of 15 to 40 times the equivalent amount. We have found that they should be partially scavenged to leave an excess of only about 8 to 20 times the equilibrium amount.

Scrutiny of the effects of temperature on NO formation revealed additional vital information. It has been reported often that Z-NO formation is temperature dependent, and that F-NO formation is not [17]. The situation is not this simple. Specifically, the positive temperature dependence for Z-NO formation becomes important only at temperatures above 1600° C. [11,18], whereas one also exists for F-NO formation, which also becomes important at above 1600° C. [3,4,11,35,37]. These facts reveal that most of the benefits of temperature reduction for NO control can be realized by burning flames at about 1600° C. Temperatures below 1600° C. may reduce NO further, but would do so by replacing it with $NO_2$ [17,21].

The last background required to postulate a plausible mechanism for the present invention involves the roles of flame structure and primary aeration on emissions production. Partially premixed flames consist of two flames; fully premixed flames consist of only one. Not apparently considered before is whether their mechanisms for emissions production, and their dependence on primary aeration, were the same. For example, do dual or single flames generate either F-NO, Z-NO, or both, and are the possible combinations a function of the primary aeration? An analysis of the situation proved enlightening.

In theory, up to four NO-production mechanisms can be active in partially premixed flames, and up to two in fully premixed flames. The real situation is not this simple. Singular facts allowed insight into why the present invention controls NO and total emissions more effectively at 100% primary aeration than at 85% and why it was effective at all at a primary aeration of less than 100%.

First, research on $CH_4$ and $C_2H_6$ combustion reveals that ppm levels of F-NO are emitted only when the primary aeration is between 65% and 135% [7]. F-NO formation is effectively "off" when the primary aeration is outside these limits. Second, F-NO does not form in flames with CO and/or hydrogen ($H_2$) as fuels [4,17,23]. Third, a primary aeration level of less than 100% exists at which all the hydrocarbon fuel is consumed, no HCs escape the flame, and fuel-carbon appears as CO [12]. This "limiting" primary aeration is about 85% for $CH_4$ and $C2H_6$ [14,34]. Last, in many partially or fully premixed flames, total NO is distributed nearly equally between F-NO and Z-NO [1,13,22,39].

In fully premixed single flames, if the primary aeration is greater than 130%, F-NO is effectively "off". Knowing this, a reduction of about 50% in total NO could be predicted, and has been observed [45].

In partially premixed flames, inner-flame F-NO is "on" if the primary aeration is greater than 65%. But is outer-flame F-NO also "on" and does it remain "on" as primary aeration increases? We now know the answers to these questions, which until now had not been asked. Their consequences were important.

At primary aerations greater than 85%, the exhaust of the inner, partially premixed flame, which is the fuel for the outer diffusion flame, converts from CO, $H_2$, and HC, to just CO and $H_2$. Hence, the HC required for F-NO formation is no longer available, and F-NO cannot form in the outer flame. Some reduction in total NO might then be expected. Apparently, it is not realized [38].

That a reduction in the number of active NO-formation mechanisms does not lower total-NO implies that the rate of NO formation via the remaining mechanisms is accelerated. With no HCs to oxidize, surplus OH radicals within the flame would be expected to persist, or even increase, which could promote the formation of both Z-NO and F-NO via Reaction 2. OH-radical overshoots maximize near the base of flames with primary aerations of 85% to 99% [20,28,30,34,36]. Thus, while only three of the four NO mechanisms may be active in partially premixed flames (1 F-NO; 2 Z-NO), they remain governed to a great extent by the surplus of OH radicals, which may grow. The absence of HCs would also disfavor the formation of other nitrogen oxides and acids.

Hence, as primary aeration approaches 85%, a unique condition exists at which to simultaneously control total emissions. The key is to reduce OH overshoots early, with minimal reduction in temperature. The inherent condition improves as primary aeration increases, because the surplus of free radicals becomes less [20]. The effectiveness of the porous member at emissions reduction would also improve in turn, because there is less of a radical overshoot to scavenge. Hence, the primary-aeration dependence of the porous member's effectiveness for emissions control can be rationalized.

The mode of operation for our non-radiant porous members can now be described. The porous members are deliberately positioned at the relatively cool (e.g. about 500° C.) base of partially (more than 85%) or fully (at least 100%) premixed blue flames. Because of their high porosity (typically about 95%), and low thermal mass, the porous member transfers little heat from the flame, and does not radiate. Minimal heat-transfer allows the blue flames to remain relatively hot (above 1600° C.), achieving most of the thermal control available over both F-NO and Z-NO formation.

At these hot temperatures, nascent surpluses in freeradicals are moderate. As flame gases "filter" through the internal pore structure of the porous member, the surface recombination of free radicals is promoted, reducing their concentration. A reduction in free-radical overshoot early in the flame reduces the surplus throughout the flame, causing a continuous chemical retardation of NO formation.

Physical contact between flame gases at the base of the flame and the internal pore structure of the member is important in providing the simultaneous reduction of nitrogen, carbon, and hydrocarbon emissions. Experiments elsewhere reveal that as flame temperatures are reduced to about 1600° C. without such physical contact, NO emissions are reduced by about 85%, but $NO_2$ and CO emissions remain at unacceptably high double-digit and triple-digit levels.[48]

The porous member must be only partially effective as a free-radical scavenger to achieve total emissions control. Concentrations of free radicals must not be reduced toward equilibrium values too early. Sufficient free radicals, or more so, must remain to complete the combustion process, that is, to oxidize any products of incomplete combustion, such as $CH_2O$ or CO, to $CO_2$.

Experimental and computational data indicate that the surplus of free radicals should not be reduced by more than a factor of about 2, or CO emissions might increase, rather than decrease.[28] As mentioned above, the scavenging should leave an excess of about 8 to 20 times the stoichiometric amount.

A secondary effect in operation is that the warmed porous member might mildly preheat secondary air before it is entrained, and contacts and quenches the flame. This thermal buffering, which would effectively reduce the differential between the combustion and ambient temperatures, would reduce quenching, and thereby would reduce $NO_2$ and CO formation at the outer edges of the flame. Subsequently, with less precursor $NO_2$ being formed, nitrogen-acid formation would also be diminished.

For effective interaction, a porous member must have a geometry that contacts the base of flames. Most appliance flames are conical or pyramidal in structure. Most arrays of appliance flames are circles or rows [24,31]. Therefore, rings and rods should dominate the shapes of porous members.

The thickness of the porous member is governed by flame temperature and height. Exposure to local temperatures above 700° C. must be avoided, as the insert would then radiate. The porous member's dimensions must be small compared to the height of single or double flames. Because more than half of the surface area of a right cone is present in the first third of its height, the thickness of the porous member need be only about 30% of the total flame height to achieve effective contact. The preferred dimensions of the porous member are specific to burner design, and to maximum and minimum firing rate (turndown ratio). With the porous member located at the base of the flame, changes in its effectiveness upon turndown are minimized.

The porous member is in a proper position when it is placed at the base of the cone-shaped blue flames emerging from the ported burner, the blue-flame structure assumes a somewhat flat domelike shape above the surface of the burner as in FIG. 3C, and the porous member does not appear to glow red hot.

Figure 3:
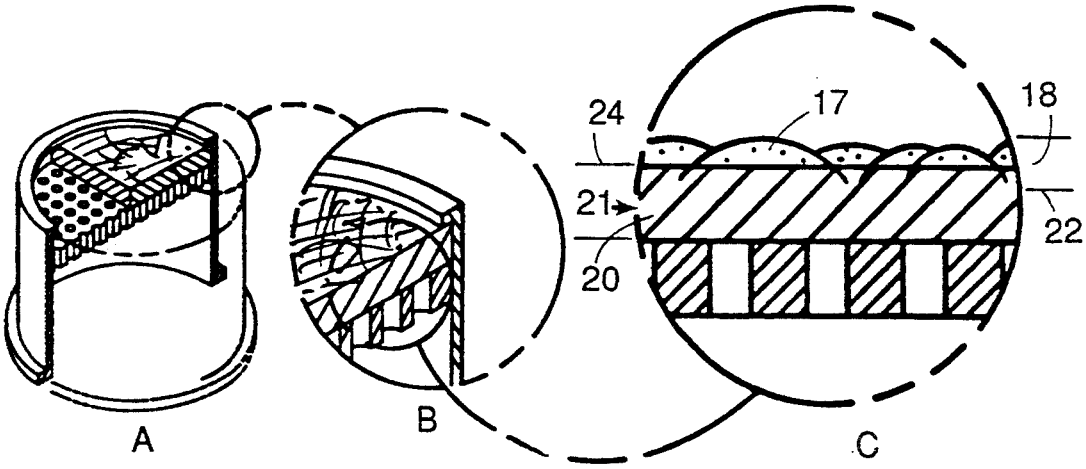
Figure 4:
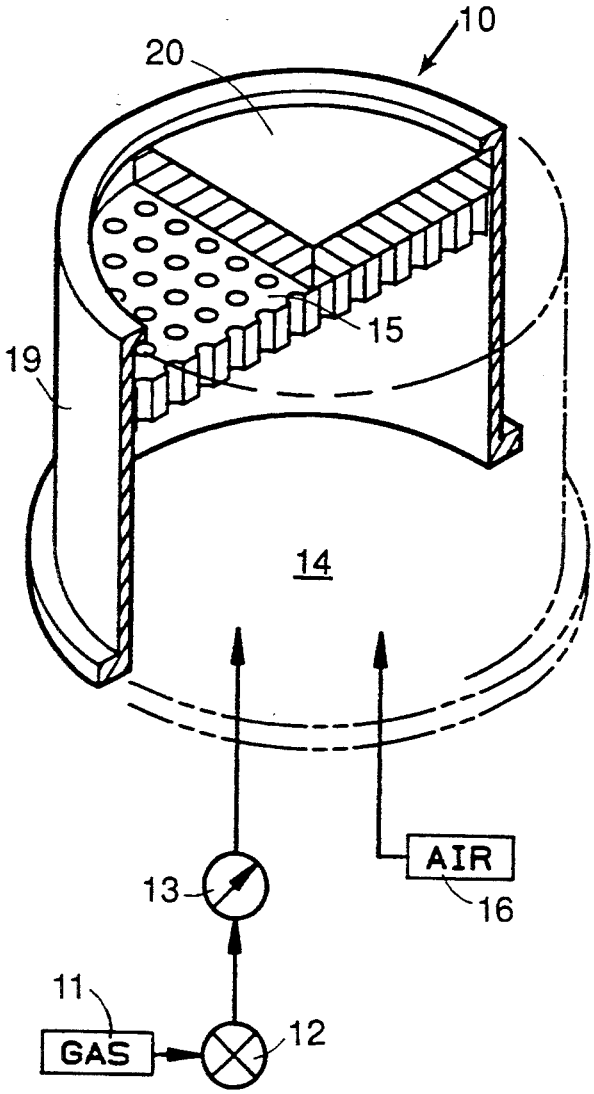
FIG. 4 is a schematic and partly sectional view of typical apparatus according to this invention including a burner as in FIG. 3 and associated means included in some of the claims herein.
Figure 5:
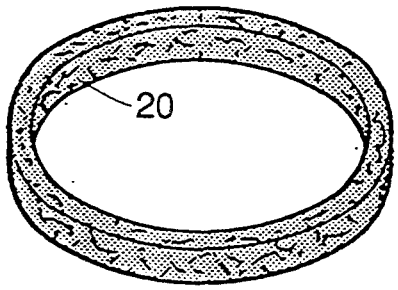
FIG. 5 is a perspective view of a typical porous member according to the present invention for fitting as an insert on a currently common type of rangetop burner cap to reduce emissions of pollutants therefrom during burning.
Figure 6:
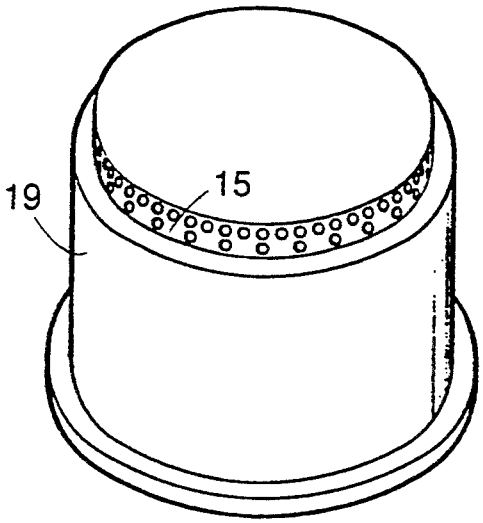
FIG. 6 is a perspective view of a typical rangetop burner cap onto which a porous member as in FIG. 5 can be conveniently and effectively fitted.

Referring now to the drawings, and particularly to FIGS. 3 and 4, typical apparatus 10 according to the present invention for burning a mixture of gaseous fuel and air with substantially minimal emission of gaseous pollutants containing nitrogen, hydrogen, or carbon; comprises means 11, 12, 13, 14, 15 (typically comprising a source of gas 11, an on-off valve 12, a variable opening valve 13, the opening 14 in the lower end of the burner 19, and a perforated flat support 15 in the upper end of the burner 19) for providing, along a predetermined path and at a pressure suitable for burning, a mixture of gaseous fuel 11 and air 16 in a ratio that is slightly fuel rich to slightly fuel lean;

means (not shown, which may be conventional) for igniting the mixture to provide a blue flame 17 in a burning region 18 in a non-radiant burner 19; and a metallic, ceramic, or other refractory porous member 20 porous enough to avoid reducing the pressure in the mixture by more than a negligible amount, located in the path of the mixture in the region 21 adjacent to the upstream end 22 of the burning region 18 and extending into the flame 17 to a level 24 at about 25 to 50 percent of the height of the flame 17, to reduce the temperature of combustion slightly by scavenging a substantial fraction of the excess free radicals that are critical to the formation of nascent NO and its conversion to $NO_2$ and the nitrogen acids.

The porous member 20 typically is constructed and arranged to reduce the temperature of combustion by about 230 to 270 degrees Celsius, and to scavenge about 40 to 60 percent of the excess free radicals that are critical to the formation of nascent NO and its conversion to $NO_2$ and the nitrogen acids.

Typically gaseous fuel comprises essentially natural gas or propane, and has about 80 to 120 percent theoretical air. In typical preferred embodiments of the invention the mixture is about stoichiometric, having about 95 to 105 percent theoretical air.

The porous member 20 may comprise a honeycomb of beads, wires, filaments, threads, ribbons, needles, fibers, screens, or lattices; or baffles of iron, copper, aluminum, or other metal or alloy thereof; or alumina, silica, zirconia, silicon carbide, or other reticulated ceramic.

The porosity in the porous member 20 should be about 92 to 97 percent, and preferably is about 93 to 95 percent.

A typical method according to this invention for substantially minimizing emission of gaseous pollutants containing nitrogen, hydrogen, or carbon, from a flame that is burning a mixture of gaseous fuel and air; comprises providing a porous member 20 in a region 18 encompassing the leading edge 22 of the flame 17 where the temperature is low enough to avoid causing the porous member 20 to radiate;

the porous member 20 extending into the flame 17 to a level 24 at about 25 to 50 percent of the height of the flame 17.

The porous member 20 preferably is provided in a region 21 where the temperature is less than about 700° C.; and is constructed and arranged to partially scavenge the free radicals that are critical to the formation of nascent NO and its conversion to $NO_2$ and the nitrogen acids, while leaving enough of the free radicals remaining to complete the combustion of the fuel by oxidizing any products of incomplete combustion, typically about 1.7 to 2.3 times the quantity of the free radicals required by equilibrium.

Typically a method according to the present invention for burning a mixture of gaseous fuel and air with substantially minimal emission of gaseous pollutants containing nitrogen, hydrogen, or carbon; comprises providing, along a predetermined path and at a pressure suitable for burning, a mixture of gaseous fuel 11 and air 16 in a ratio that is slightly fuel rich to slightly fuel lean;

igniting the mixture to provide a blue flame 17 in a predetermined burning region 18 in a non-radiant burner 19; and providing in the path of the mixture, in the region 21 adjacent to the upstream end 22 of the burning region 18, a metallic, ceramic, or other temperature stable (refractory) porous member 20 porous enough to avoid deleteriously reducing the pressure in the mixture, to reduce the temperature of combustion slightly by scavenging a substantial fraction of the excess free radicals that are critical to the formation of nascent NO and its conversion to $NO_2$ and the nitrogen acids.

The partial scavenging typically leaves excess free radicals in the range of about 8 to 20 times the equivalent amount.

While the forms of the invention herein disclosed constitute currently preferred embodiments, many others are possible. It is not intended herein to mention all of the possible equivalent forms or ramifications of the invention. It is to be understood that the terms used herein are merely descriptive rather than limiting, and that various changes may be made without departing from the spirit or scope of the invention.

References

1. Rosenberg, R. and Hacker, D., "Formation of Nitrogen Oxides in Aerated Methane Flames" American Chemical Society Division of Fuel Chemistry Preprints 10, 91–103 (1966).
2) Rosenberg, R and Larson, D., "Formation of Nitrogen Oxides in Aerated Methane Flames" American Gas Association Basic Research Symposium, 18 pp. (1967).
3) Rosenberg, R , Weil, S , and Larson, D., "The Different Effects of Flame Chemistry on the Formation of Ethylene and the Oxides of Nitrogen in Flames" American Chemical Society Division of Fuel Chemistry Preprints 13, 137–151 (1969).
4. Fenimore, C., "Formation of Nitric Oxide in Premixed Hydrocarbon Flames", Thirteenth Symposium (International) on Combustion, 373–380 (1971).
Peeters, J. and Mahnen, G. , "Reaction Mechanisms and Rate Constants of Elementary Steps in Methane-Oxygen Flames", Fourteenth Symposium (International) on Combustion, 133–146 (1973).
6. Iverach, D., Basden, K., and Kirov, N., "Formation of Nitric Oxide in Fuel-Lean and Fuel-Rich Flames" Fourteenth Symposium (International) on Combustion, 767–775 (1973).
7. Bachmaier, F , Eberius, K , and Just, T., "The Formation of Nitric Oxide and the Detection of HCN in Premixed Hydrocarbon-Air Flames at 1 Atmosphere" Combustion Science and Technology 7, 77–84 (1973).
8. Iverach, D. , Kirov, N. , and Haynes, B., "The Formation of Nitric Oxide in Fuel-Rich Flames", Combustion Science and Technology 8, 159–164 (1973).
9. Ay, J. and Sichel, M., "Theoretical Analysis of NO Formation Near The Primary Reaction Zone in Methane Combustion", Combustion and Flame 26, 1–15 (1976).
10. Smoot, L., Hecker, W., and Williams, G., "Prediction of Propagating Methane-Air Flames" Combustion and Flame 26, 323–342 (1976).
11. Harris, R., Narsalla, M., and Williams, A., "The Formation of Oxides of Nitrogen in High Temperature $CH4$-$O_22$-$N_2$ Flames", Combustion Science and Technology 14, 85–94 (1976).
12. Kaskan, W. and Reuther, J., "Limiting Equivalence Ratio, Dissociation, and Self-Inhibition in Premixed, Quenched, Fuel-Rich Hydrocarbon/Air Flames", Sixteenth Symposium (International) on Combustion, 1083–1095 (1977).
13. Roper, F., Einarsson, S., and Kayes, P., "NO formation in the outer diffusion flame of bunsen-type flames" Fuel 57, 187–188 (1978).
14. Matsui, Y. and Nomaguchi, T., "Spectroscopic Study of Prompt Nitrogen Oxide Formation Mechanism in Hydrocarbon-Air Flames" Combustion and Flame 32, 205–214 (1978).
15. Tsatsaronis, G., . "Prediction of Propagating Laminar Flames in Methane, Oxygen, Nitrogen Mixtures" Combustion and Flame 33, 217–239 (1978). in Premixed Flames", Seventeenth Symposium (International) on Combustion, 647–660 (1979).
17. Hayhurst, A. and Vince, I., "Nitric Oxide Formation from $N_2$in Flames: The Importance of "Prompt" NO" Progress in Energy and Combustion Science 6, 35–51 (1980).
18. Miyauchi, T., Mori, Y., and Yamaguchi, T., "Effect of Steam Addition on NO Formation", Eighteenth Symposium (International) on Combustion, 43–51 (1981).
19. Hargreaves, K., Harvey, R., Roper, F., and Smith, D., "Formation of $NO_2$ by Laminar Flames", Eighteenth Symposium (International) on Combustion, 133–142 (1981).
20. Cattolica, R., "OH Radical Nonequilibrium in Methane-Air Flat Flames" Combustion and Flame 44, 43–59 (1982).
21. Sano, T , "$NO_2$ Formation in Laminar Flame" Combustion Science and Technology 29, 261–275 (1982).
22. Coutant, R., Merryman, E., and Levy, A. , "Formation of $NO_2$ in Range-Top Burners" Environment International 8, 185–192 (1982) .
23. Hayhurst, A. and Vince, I., "The Origin and Nature of "Prompt" Nitric Oxide in Flames"50, 41–57 (1983).
24. DeWerth, D. and Sheridan, R., "Regulation of Blue Flame Combustion Emissions" U.S. Pat. No. 4,525,141, Jun. 25 (1985).
25. Sano, T., "$NO_2$ Formation in the Mixing Region of Hot Burned Gas with Cool Air" Combustion Science and Technology 38, 129–144 (1984).
26. Zawacki, T., Cole, J., Huang, V., Banasiuk, H., and Macriss, R., "Efficiency and Emissions Improvement of Gas-Fired Space Heaters: Task 2. Unvented Space Heater Emissions Reduction", Final Report from the Institute of Gas Technology to the Gas Research Institute, GRI-84/0021, June (1984).
27. Sano, T., "$NO_2$ Formation in the Mixing Region of Hot Burned Gas with Cool Air-Effect of Surrounding Air", Combustion Science and Technology 43, 259–269 (1985).
28. Drake, M., Correa, S., Pitz, R., Shyy, W., and Fenimore, C., "Superequilibrium and Nitric Oxide Formation in Turbulent Diffusion Flame" Combustion and Flame 69, 347–365 (1987).
29. Hori, M., "Nitrogen Dioxide Formation by the Mixing of Hot Combustion Gas with Cold Air" Twenty-Second Symposium (International) on Combustion, 1175–1181 (1988).
30. Kaiser, E., "Simulation of OH Radical Profiles in Premixed Atmospheric-Pressure Flat Flames" Journal of Chemical Physics 92, 4384–4389 (1988).
31. Reuther, J., "Effect of Rangetop Burner Design on $NO_2$Emissions" GRI-89/0030, Final Report from Battelle Columbus Division to the Gas Research Institute, 77 pp. (1989).
32. Minden, A., Perkins, D., and Kennedy, J., "Premixed Radiant Burners: Improved Process Performance with Ultra-Low $NO_x$ Emissions" American Flame Research Committee International Symposium on NOx Control., Waste Incineration, and Oxygen Enriched Combustion, Paper 28 (1990).
33. Reed, R. and Lang, R., "NO Reduction in Industrial Heat Processing", Industrial Heating, pp. 39–43 (1990).
34. Kaiser, E., "Measured and Computer-Simulated Hydrocarbon and OH Radical Profiles in Fuel-Rich Atmospheric-Pressure Flat Flames: Reactions of $CH_4$ and $C_2H_2$", Journal of Physical Chemistry 94, 4493–4499 (1990).
35. Correa, S. and Smooke, M., "$NO_x$ in Parametrically Varied Methane Flames", Twenty-Third Symposium (International) on Combustion, 289–295 (1990).
36. Van Oostendorp, D., Borghols, W., and Levinsky, H., "The Influence of Ambient Air Entrainment on Partially Premixed Burner Flames: LIF Imaging of CO and OH", Combustion and Flame 79, 195–206 (1991).
37. Heard, D., Jeffries, J., Smith, G., and Crosley, D., "LIF Measurements in Methane/Air Flames of Radicals Important in Prompt-NO Formation" Combustion and Flame 88, 137–148 (1992).
38. DeWerth, D. and Loria, R., "Evaluation of $NO_x$ Emissions from Advanced Technology Range Burners", Final Report from American Gas Association Laboratories, GRI-92/0014 (1992).
39. Levinsky, H., Van Oostendorp, D., Van der Meij, C., Jacobs, R , and Mokhov, A., "Pollutant Formation in Household Burners: LIF Imaging of NO" International Gas Research Conference IV, 248–256 (1992).
40. Spicer, C., Kenny, D., Ward, G., and Billick, I., "Emissions of Nitrogen Dioxide and Nitrogen Acids from Unvented Appliances" International Gas Research Conference IV, 266–275 (1992).
41. Beesteheerd, J., Beckers, G., Visser, P., Tjeng,. S., and Van der Drift, A., "Low $NO_x$ Ceramic Foam Burner for Domestic and Industrial Utilization" International Gas Research Conference IV, 286–295 (1992).
42. Sullivan, J. and Kendall, R., "Thermal Performance and $NO_x$Emissions from Porous Surface Radiant Burners", International Gas Research Conference IV, 296–304 (1992).
43. Arrigotti, S., Bernstein, S., Levinsky, H., Oostendorp, D., Van der Meij, C., and Jacobs, A.,'-'Numerical and Experimental Investigation of a Laminar Bunsen Flame", International Gas Research Conference IV, 422–431 (1992).
44. Van der Lugt, W., "NO Reduction in Industrial Boilers" International Gas Research Conference V, 32–41 (1992).
45. Morenzo, F., Pam, R., and Chirolo, D., "Theory and Application of Ultra Low $NO_x$ Radiant Combustion: Sub-9 PPM Without SCR" International Gas Research Conference V, 402–412 (1992).
46. Reuther, J., "Experiments on the Effect on Emissions of Porous Inserts in Gas-Appliance Flames", Final Report from Battelle to the Gas Research Institute, Jan. 31, 1993.
47. Weber, E. and Vandaveer, F., "Gas Burner Design" Chapter , 12, 193–210, Gas Engineers Handbook, Industrial Press (1965) .
48. Peters, B. and Borman, G., "Nitric Oxide Emissions From a Cooled Porous Disk Burner" Combustion Science and Technology 7, 159–163 (1973).
49. Reuther, J. J. and Litt, R. D., "Nested-Fiber Gas Burner" U.S. Pat. No. 5,205,731, Apr. 17 (1993).

We claim:

1. A method for burning a mixture of gaseous fuel and air in a burner, with substantially minimal emission of gaseous pollutants containing nitrogen, hydrogen, or carbon; comprising A. providing in the burner a refractory porous member having a porosity of at least about 92 percent;

B. providing along a predetermined path through the porous member, a mixture of gaseous fuel and air in a ratio that is slightly fuel rich to slightly fuel lean; and C. ignited the mixture to provide a flame in a predetermined burning region that includes at least a substantial portion of the porous member;

D. wherein the mixture is provided at a rate such that the porous member extends into the flame to a level at about 25 to 50 percent of the height of the flame and such that the porous member does not become incandescent.

2. A method as in claim 1, wherein the porous member is so constructed and arranged as to reduce the temperature of combustion slightly by scavenging a substantial fraction of the excess free radicals that are critical to the formation of nascent NO and its conversion to $NO_2$ and the nitrogen acids.

3. A method as in claim 1, wherein the porous member is so constructed and arranged as to reduce the temperature of combustion by about 230 to 270 degrees Celsius, to provide temperatures of about 1590 to 1630 degrees Celsius.

4. A method as in claim 1, wherein the porous member is so constructed and arranged as to scavenge about 40 to 60 percent of the excess free radicals that are critical to the formation of nascent NO and its conversion to $NO_2$ and the nitrogen acids.

5. A method as in claim 1, wherein the gaseous fuel comprises essentially natural gas or propane.

6. A method as in claim 1, wherein the mixture has about 95 to 105 percent theoretical air.

7. A method as in claim 1, wherein the porous member comprises a honeycomb of beads, wires, filaments, threads, ribbons, needles, fibers, screens, or lattices; or baffles of iron, copper, aluminum, or other metal or alloy thereof; or alumina, silica, zirconia, silicon carbide, or other reticulated ceramic.

8. A method in claim 1, wherein the porosity in the porous member is about 93 to 95 percent.

9. A method as in claim 1, wherein the porous member is provided in a region where the temperature is less than about 700° C.

10. A method as in claim 1, wherein the porous member is so constructed and arranged as to partially scavenge the free radicals that are critical to the formation of nascent NO and its conversion to $NO_2$ and the nitrogen acids, and to leave enough of the free radicals remaining to complete the combustion of the fuel by oxidizing any products of incomplete combustion.

11. A method as in claim 10, wherein the porous member is so constructed and arranged as to leave remaining about 1.7 to 2.3 times the quantity of the free radicals required by equilibrium.

* * * * *

UNITED STATES PATENT AND TRADEMARK OFFICE

CERTIFICATE OF CORRECTION

PATENT NO. : 5,441,402
DATED : August 15,1995
INVENTOR(S) : Reuther et al.

It is certified that error appears in the above-indentified patent and that said Letters Patent is hereby corrected as shown below:

Column 4, line 6, "(FNO + Z-NO)," should read - - (F-NO + Z-NO), - -.
Column 4, line 14, "$CO^{(26}$" should read - - $CO^{(26)}$ - -.
Column 4, line 16, "$HNO_3$formation" should read - - $HNO_3$ formation - -.
Column 4, line 18, "formation$^{(16}$," should read - - formation$^{(16)}$, - -.
Column 8, line 26, "(0)" should read - - (O) - -.
Column 14, lines 23-25, "in Premixed Flames", Seventeenth Symposium (International) on Combustion, 647-660 (1979)." should be deleted.
Column 14, line 25, insert - - 16. Johnson, G., Smith, M., and Mulcahy, F., "The Presence of $NO_2$ in Premixed Flames", Seventeenth Symposium (International) on Combustion, 647-660 (1979). - -.
Column 14, line 27, "$N_2$in" should read - - $N_2$ in - -.
Column 14, line 28, "NO"" should read - - NO", - -.

Signed and Sealed this

Seventh Day of November, 1995

*Attest:*

*Attesting Officer*

BRUCE LEHMAN

*Commissioner of Patents and Trademarks*